United States Patent [19]

Brumfield et al.

[11] 4,314,697

[45] Feb. 9, 1982

[54] PHYSICAL EXERCISING DEVICE

[76] Inventors: Maxine L. Brumfield; Jesse E. Brumfield, both of 654 Miner Ave., Columbus, Ohio 43223

[21] Appl. No.: 122,598

[22] Filed: Feb. 19, 1980

[51] Int. Cl.[3] ..... A63B 21/04

[52] U.S. Cl. ..... 272/136; 272/143; 272/142; 272/93

[58] Field of Search ..... 272/93, 136, 142, 140, 272/143, 144, 130, 67, 135

[56] References Cited

U.S. PATENT DOCUMENTS

| | | | |
|---|---|---|---|
| 3,561,022 | 2/1971 | James | 272/144 |
| 3,876,198 | 4/1975 | Seligman | 272/142 |
| 4,183,520 | 1/1980 | Chase | 272/130 |

FOREIGN PATENT DOCUMENTS

| | | | |
|---|---|---|---|
| 661778 | 5/1935 | Fed. Rep. of Germany | 272/142 |
| 496740 | 2/1937 | United Kingdom | 272/142 |

OTHER PUBLICATIONS

Marcy Equipment Catalog No. 69, Oct. 7, 1969.

*Primary Examiner*—Richard C. Pinkham
*Assistant Examiner*—William R. Browne
*Attorney, Agent, or Firm*—Robert E. Stebens

[57] ABSTRACT

A physical exercising device is provided comprising a padded wedge-shaped base and a spring-biased metal exercise bar. The exercise bar is attached near the wedge's apex and extends lengthwise parallel to the device at a predetermined distance from the wedge. The physical exercising device has its base formed from a lightweight material and additionally may have its body support surfaces covered with a layer of carpet or foam padding. The spring which has its one end attached to the exercise bar has its opposite end secured to the end panel of the wedge-shaped base to provide a biasing force. The ends of the metal bar are inserted through apertures in the end panel and terminate in the interior of the physical exercising device. The exercise bar may be of a unitary piece of tubular metal or a single metal tube with two gripping portions which may or may not be independently operable.

13 Claims, 11 Drawing Figures

PHYSICAL EXERCISING DEVICE

BACKGROUND OF THE INVENTION

This invention is directed to the providing of an effectively efficient and portable physical exercising device which is specifically designed to be utilized by persons who have physical problems such as heart attack patients and cannot engage in strenuous physical conditioning exercises. However, the device is not limited to such people as it is believed to also provide more advantageous exercising for those who do not have any physical problems of that nature. Several types of physical exercising devices are known however, these are primarily of a relatively complex and extremely large nature resulting in expensive manufacturing processes, high costs to the consumer, and thus, are not adapted to individual home use. Most of the known structures are also of a type designed for long term use in a specific location. Furthermore, the installation of many of these types of exercising devices requires a substantial outlay of money and expenditure, thus making owning such a device practical only for health spas and physical rehabilitation centers.

The most common type of physical exercising device similar to this invention is disclosed in U.S. Pat. Nos. 1,158,779 and 3,876,198. These two patents disclose exercising devices which are of a couch or bench configuration. Both feature back support surfaces which are relatively planar, although U.S. Pat. No. 1,158,779 does permit the formation of a wedge as disclosed by its FIG. 3. This wedge-shaped position is deemed to be important in exercising devices for the reduction of lower back muscle strain and the strain associated with the abdominal muscles. In this regard, U.S. Pat. No. 1,158,779 does not permit the user to bend at the waist as is desired such as for sit-up exercises. U.S. Pat. No. 3,876,198 merely shows an inclined surface having a motor driven pull up bar.

Exercise devices which are closely related to the exercise table or couch are those of a much less fixed-installation nature as shown in U.S. Pat. Nos. 3,545,748 and 3,558,131. These less bulky and less complex exercise devices possess many of the advantages of the larger exercise couches shown in U.S. Pat. Nos. 1,158,779 and 3,876,198, but may be disassembled and are more readily stored, an important factor for exercise devices to be used in the home. However, the structures in these two patents, as well as the patents resembling couches, all feature a back support surface as part of the exercise device. None of them seek to use the floor surface as a means for providing back support.

Additionally, none of the patents utilize a bar in a manner such that it can provide a variety of exercise functions. The bars in these patents serve only a limited number of exercise functions or else assist in providing a leg restraint for exercises such as sit-ups. U.S. Pat. No. 1,158,779 has a strap 80 which serves only to secure the legs to the device. A similar strap is found in U.S. Pat. No. 3,876,198 as designated by strap 60 in U.S. Pat. No. 3,545,748 in strap 14. U.S. Pat. No. 1,158,779 also has a bar 41, but its use appears limited to arm exercises and it is incapable of serving as a leg restraint. U.S. Pat. No. 3,558,131 also has bars 72, 38 and 40, but all assist in lifting type exercises, while none serve as a leg restraint. U.S. Pat. No. 3,545,748 also has a bar which only assists in the lifting type exercise since even in FIG. 10, it is the strap, not the bar, which serves as a leg restraint. Similarly, U.S. Pat. No. 3,876,198 also has a bar 50, but it does not serve as a leg restraint buy only as an aid in lifting type exercises.

It is also known that some exercise devices are spring-biased. Such a device is shown in U.S. Pat. No. 3,558,131 in which the spring serves as a means to provide substantial tension for the movement of various bars. However, that exercise apparatus does not incorporate a wedge-shape nor does its bar function as a leg restraint. U.S. Pat. No. 3,876,198 also includes a spring, but that exercise device is motor driven and the spring 84 does not function as a tension means.

SUMMARY OF THE INVENTION

In accordance with this invention, a physical exercising device is provided for advantageous use to facilitate the exercising of persons who may have physical problems such as a heart condition. However, the device is not limited to such people as it is believed to also provide advantageous exercising capabilities for those who do not have any physical problems. The physical exercising device structure of this invention is comprised of a wedge-shaped base support unit and an exercise bar with a resistance means interconnecting the two. The wedge-shaped base unit is formed from a thin sheet material having sufficient structural strength. Possibilities for this sheet material would include lightweight metals, plastic sheets wood or pressed fiberboard. All that is required is that the sheet material have a thickness suitable for supporting portions of the human body while at the same time being lightweitht enough to facilitate relatively easy transport of the device. In accordance with this invention, an exercising device comprising a padded wedge and exercise bar has this exercise bar spring-biased and attached near the wedge's apex. The exercise bar then extends lengthwise parallel to the device at a predetermined distance from the wedge.

Included in the physical exercising device of this invention is a base support unit having a wedge-shape configuration. This unit includes two body engaging panels of elongated rectangular configuration forming body support surfaces and two upstanding end panels. The two end panels are of a generally triangular configuration having truncated lower corners. An aperture is formed in each end panel near the upper apex and provides a socket for mounting of the exercise bar on the wedge-shaped base unit. The body support panels of the base unit may have a padding or layer of cushioning material secured onto their exterior surface to provide body comfort during periods of exercise. This padding may be either of a foam or carpeted nature.

The exercise bar is advantageously formed from a single metal tube which extends exteriorly of the wedge and passes from one end of the body support to the other. While preferably this exercise bar is unitary in construction, it is possible to have a section removed from the longitudinal portion of the bar, thus resulting in a bar having two separate gripping portions. Also, it would be possible to interconnect the two sections of the bar interiorly, thus producing gripping portions which would act independently of one another. An attachment means is provided on each end of the exercise bar and another attachment means is provided on the end panel itself with the two attachment units being connected by a spring which serves as a resistance means.

The primary objective of this invention is to provide a beneficial physical exercise device that is of extremely economical construction and simple to utilize by merely positioning it on a floor at any desired location and is maintained functional operational relationship on a floor surface through utilization. This device is designed for use by any individual wanting to exercise a number of muscle areas of the body such as legs, arms, back and abdomen. Important aspects of this objective are the compact nature and relatively small size of the device and its wedge-shaped configuration. The unit's small size and light weight make it practical for use in the home as it may be easily stored and is readily portable to a convenient location. Additionally, for patients undergoing physical therapy, the device permits physical rehabilitation in the home, thus lessening the time and money associated with treatments at a health center that may otherwise be necessitated. The general wedge-shaped configuration of the device increases the safety associated with this device in that the chance of an injury is lessened by eliminating a completely flat exercise surface. The use of a wedge to support the legs when doing exercises designed to strengthen or tone the stomach muscles decreases the likelihood of injury to those muscles and to those of the lower back.

Another objective of this invention is to provide a physical exercising device capable of being used to perform a variety of exercises. This important objective allows the device to be used to strengthen several areas of the body. For example, this physical exercising device benefits the biceps, shoulders pectoral muscles, calves, thighs, hips, knees, waist, abdominal muscles, hamstring, wrist and forearm, as well as the cardiovascular and respiratory systems.

Still another objective of this invention is to provide a physical exercising device which is easy to use. It must be realized that physically handicapped individuals as well as middle aged and elderly persons can take advantage of the beneficial rewards associated with the use of this device. Therefore, it is extremely important that the deviced be designed so that these groups of persons may easily be able to understand the methods of utilizing the device. Important aspects associated with the ease of using this device are the facts that there are no motorized or mechanized parts susceptible of breakage. Additionally, the individual using the device may proceed at his or her own rate. Also, the fact that the device is designed to be utilized on the floor eliminates the fear of an elderly individual of possibly falling from a conventional exercise table and sustaining a serious injury. Furthermore, this aspect of the device permits handicapped individuals to more easily use the device since they need not be lifted onto an exercise couch.

These and other objects and advantages of this invention will be readily apparent from the following detailed description of an illustrative embodiment thereof, reference being had to the accompanying drawings which illustrate the embodiment of the invention.

DESCRIPTION OF THE DRAWING FIGURES

Figure 6:
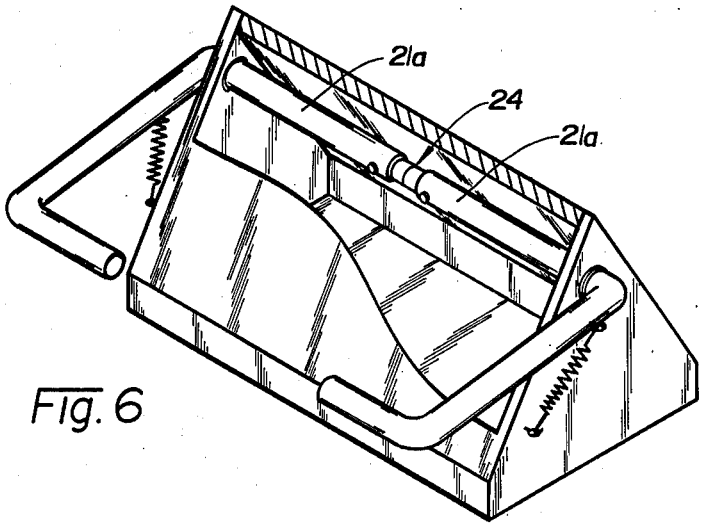
FIG. 6 is a perspective view of another modified device with portions of the structure broken away to show the interior.
Figure 6A:
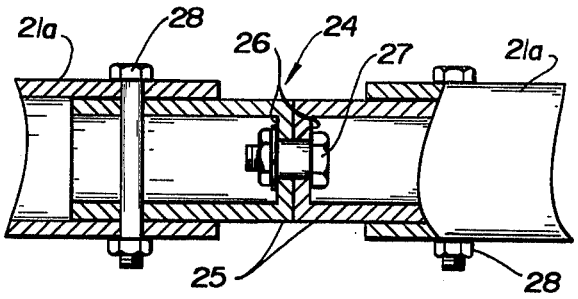

FIG. 6*a* is a fragmentary longitudinal sectional view taken along line 6A—6A of FIG. 6.

Figure 7:
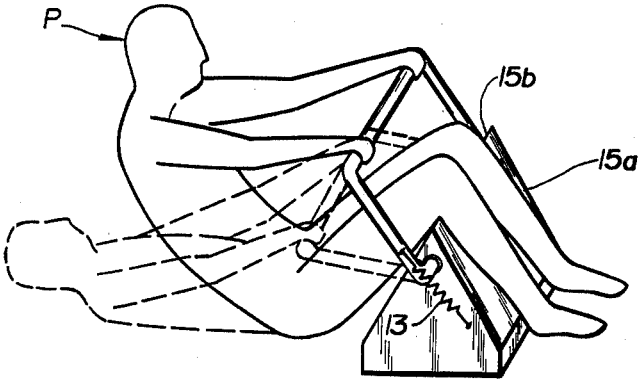

FIG. 7 is a perspective view of the device with a representation of a person performing a sit-up exercise.

Figure 8:
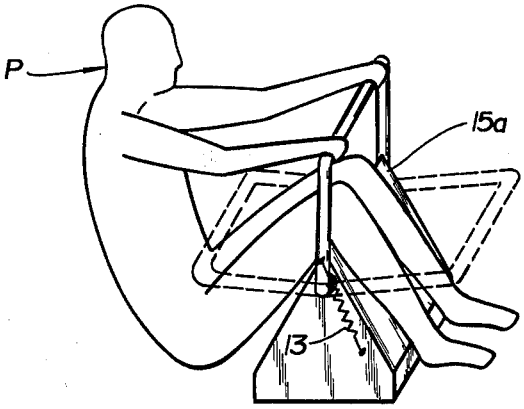

FIG. 8 is a perspective view of the device with a representation of a person performing a rowing exercise.

Figure 9:
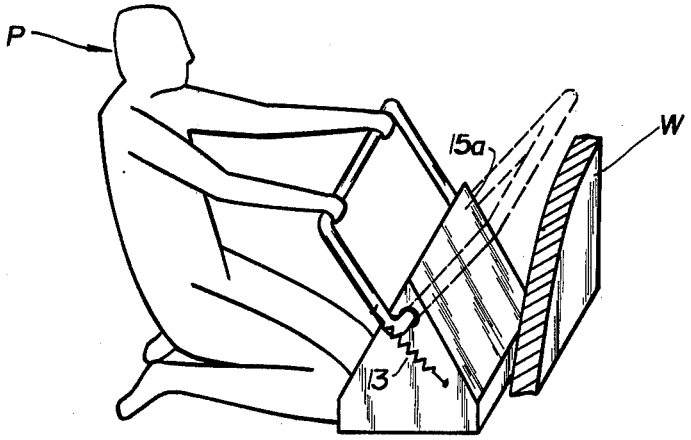

FIG. 9 is a side perspective view of the device with a representation of a person performing an arm stretch and waist band exercise.

Figure 10:
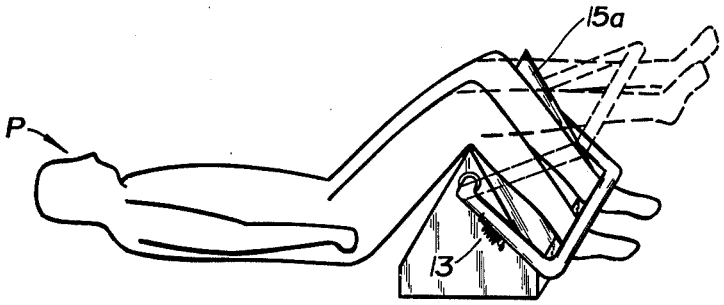

FIG. 10 is a side perspective view of the device with a representation of a person performing a leg raise exercise.

DESCRIPTION OF THE ILLUSTRATIVE EMBODIMENT

Figure 1:
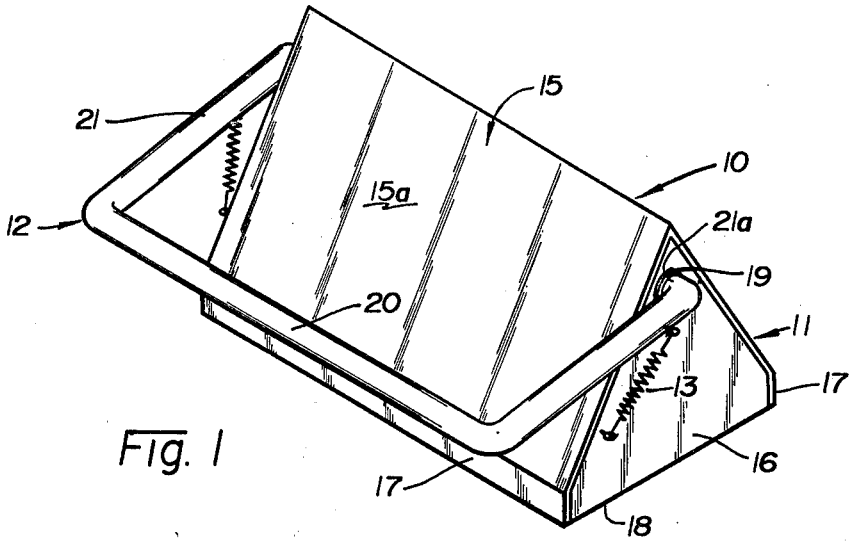
FIG. 1 is a front perspective view of a physical exercising device embodying my new invention.

Having reference to the drawings, attention is directed first to FIG. 1 which illustrates a physical exercising device structure embodying this invention and designated generally by the numeral 10. The physical exercising device 10 includes as its basic component, a wedge-shaped base unit 11 and an exercise bar 12. The wedge-shaped base unit 11 acts in conjunction with the exercise bar 12 which is preferably spring-biased by a helical spring 13 which is attached near the wedge's apex. This wedge-shaped base unit 11 is formed from any suitable lightweight sheet material. Possibilities for construction materials could include fiberglass, plastic, metal or wood. The construction materials are selected to be light in weight but having a structural strength capable of supporting a human body.

In accordance with this invention, the wedge-shaped base unit 11 is of an elongated configuration and is comprised of a body support surface 15 and opposed end panels 16. A bottom panel (not shown) may be provided to increase the structural integrity of the base unit but is preferably omitted to decrease weight if the necessary structural strength can be otherwise assured. The body support surface 15 has two surfaces or panels 15*a*, 15*b* on which a body may be supported and these surfaces are inclined upwardly with respect to the bottom or base of the unit such that two support surfaces 15*a* and 15*b* meet at an elevated apex. Dimensionally, the base unit 11 is twenty-one (21) inches long with each of the two support panels 15*a*, 15*b* being approximately fourteen (14) inches wide. The unit is also about fourteen (14) inches wide at the base thus resulting in a generally equilateral triangular cross-sectional configuration.

To alleviate any possible discomfort which may either be associated with the apex itself or the relatively rigid body support surfaces 15*a*, 15*b*, it is desirable to cover the body support surface 15 with a layer 14 of suitable material forming a padding or cushion. This padding could either be of a cellular foam, either synthetic or natural, or a piece of textile carpeting. Additionally the providing of a padded layer aids in maintaining the body's position relative to the physical exercising device while exercising.

At opposite ends of the physical exercising device 10 are respective end panels 16 which are of a triangular configuration. The end panels 15 have truncated corner portions 17 adjacent to a bottom edge of the end panel.

This truncated portion of the end panel permits the device 10 to occupy less surface space while also strengthening the structure in this area. Also, the truncated lower corner of the base unit does not perform any useful support function in utilization of the device. Near the top of each end panel 16 is an aperture 19 through which terminal end portions of the exercise bar 12 pass to pivotally secure it to the wedge-shaped base 11. These apertures are centrally located about nine (9) inches above the bottom edge 18.

The exercise bar 12 is comprised of two main portions, one of which is an elongated gripping portion 20 about twenty-four (24) inches long that extends from one end of the wedge-shaped base unit to the other. Connecting portions 21 of the exercise bar 12 serve to pivotally connect the gripping portion 20 to the wedge-shaped base 11 and comprise transverse extensions of the gripping portion, each having inturned terminal end portions 21*a* which extend through the apertures 19. The connecting portions 21 thus pivotally support the gripping portion 20 for swinging movement about the base unit. This exercise bar 12 may be formed from a tubular piece of metal or other structural material capable of sustaining a considerable amount of weight or pressure. The bar may be about one (1) inch in diameter with the connecting portions 21 being about twelve (12) inches long.

As previously indicated, the exercise bar is also provided with spring biasing means in the form of a pair of helical tension springs 13. This springs 13 are each secured at one end to a respective one of the exercise bar connecting portions 21 by an eyebolt 22 and the other end to a respective end panel by another eyebolt 23. The spring in the illustrative embodiment is about five (5) inches long with its attachment to the bar connecting portion 21 being displaced about three (3) inches from its pivot axis. The opposite end connection to the end panel 16 is made at point which is about one and one-half ($1\frac{1}{2}$) inches inwardly of the one upwardly inclined edge and three (3) inches above the bottom edge 18. The particular spring selection is made on the basis of the degree of resilient biasing or resistive force that may be desired by a particular person using this device.

Figure 2:
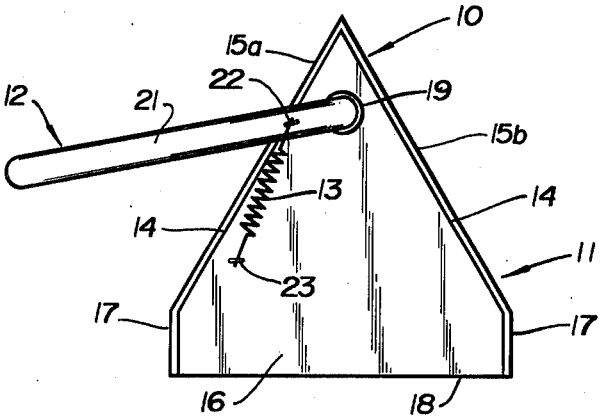
FIG. 2 is an end elevational view thereof.
Figure 3:
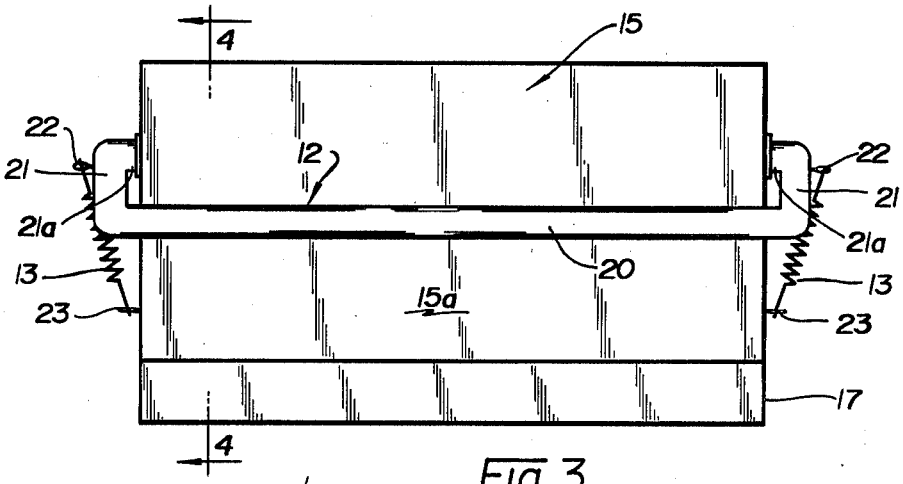
FIG. 3 is a side elevational view thereof.
Figure 4:
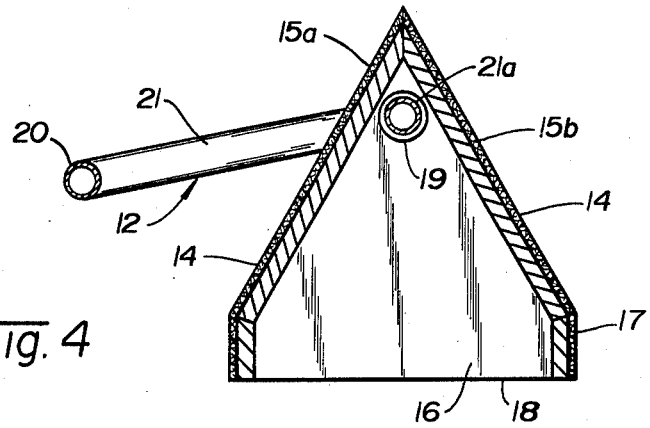
FIG. 4 is a transverse sectional view taken along line 4—4 of FIG. 3.
Figure 5:
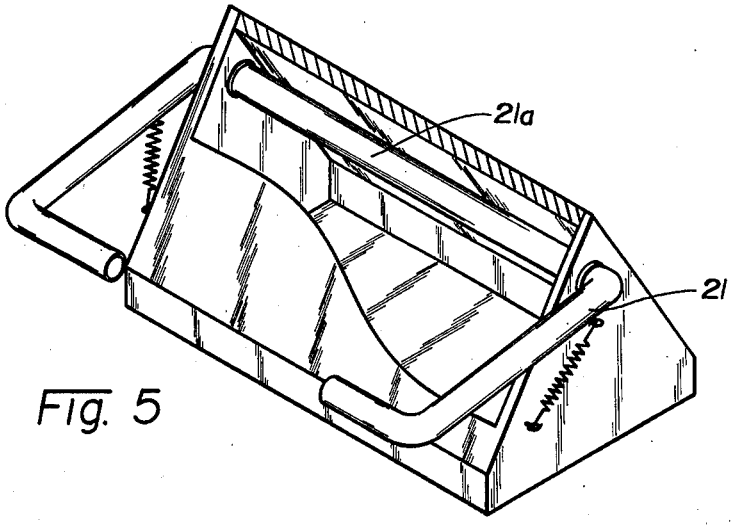
FIG. 5 is a perspective view of a modified device with portion of the structure broken away to show the interior.

Preferably, the exercise bar 12 will be of the configuration shown in FIGS. 1 and 2. That particular type of exercise bar is of a unitary construction and has itself secured to the wedge-shaped base unit as shown in the drawing FIGS. 1-4. However, the gripping portion need not be unitary and may be split at its midpoint as is shown in FIGS. 5 and 6 that illustrate alternative structures. In the structure of FIG. 5, the terminal end portions 21*a* are rigidly interconnected interiorly of the base unit 11 with the exercise bar remaining of a unitary construction thereby retaining the feature of synchronized operation of the two gripping portion elements 20*a*. The spacing between the opposed ends of the two gripping portion elements may be of a dimension such that a user of the device may readily pass his legs through that space rather than extend his legs between the continuous bar portion 20 and base unit 11 as in the case of the first illustrated embodiment. The further modification shown in FIG. 6 is similar to that of FIG. 5 but the terminal end portions 21*a* of the bar are not fully rigidly interconnected. In this embodiment a connector unit 24 is provided and is designed to restrain the terminal end portions 21*a* against relative axial movement but permit relative rotational movement. A suitable connector 24 for this purpose may comprise two axially aligned sections of tubing 25 having opposed end walls 26 as can be best seen in FIG. 6*a*. A bolt 27 extending through these end walls 26 forms a swivel connection and the tube sections 25 are fixed in the respective terminal end portions 21*a* of the exercise bar by bolt type fasteners 28. This modification thus permits greater versatility through independent operation of the two exercise bar sections.

The dimensional configuration described is deemed optimum for most persons of adult stature; however, those dimensions can be modified to meet specific physical characteristics. The wedge-shaped base unit 11 is preferably dimensioned to essentially coincide with average upper and lower leg sizes and permit a person's feet to rest on the floor when a person is laying on his back in some of the exercise functions of the device as will be explained and as illustrated.

FIGS. 7, 8, 9 and 10 show the physical exercising device in a few of its many possible exercising operations. Exercises may be done utilizing this device for the stomach, back, pelvis, arms and legs. In particular, the device may be used for leg raises, hip and leg thrusts, leg presses, arm stretches and waist bends, sit-ups, leg and arm swings, touching of the toes and rowing. This extremely useful physical exercising device aids in the facilitation of these various exercises while strengthening numerous muscles, improving body posture, reducing body fat and improving the individual's cardiovascular and respiratory systems.

FIG. 7 shows an individual P utilizing the device for the doing of sit-up exercises. The physical exercising device 10 is first placed on a floor F at a convenient location. The person P then positions himself such that his hips come into contact with the one body support surface panel 15*a* and extends his legs through the space between the exercise bar gripping portion 20 and base unit 11. In this position, the exercise bar 12 rests on his legs at a point above the knees. The exercise bar 12 thus serves as a leg restraint to enable the person to accomplish the exercise more easily. Additionally, the wedge-shaped configuration of the device tends to eliminate injuries to the lower back and the abdominal muscles. The individual may then proceed with the sit-up exercises. In some physical condition situations of an individual, it may be desirable to provide some assistance, at least during the initial phase of a sit-up from a prone position. In such cases, the individual may swing the exercise bar 13 to the illustrated broken line position where the person may then grasp the gripping portion and use his arms to aid by pulling himself to a sitting position.

FIG. 8 illustrates a person performing a rowing exercise. For this exercise, the individual positions his legs beneath the exercise bar such that his hips rest against the body support surface section 15*a*. He then leans forward grasping the exercise bar 20 with his hands. Then, by moving the trunk of the body backward and forward, a simulated rowing exercise is achieved for the benefit of his arm, back and stomach muscles as they work to overcome the resistance created by the spring 13 as the exercise bar is moved from one to the other illustrated broken line positions.

FIG. 9 shows an individual performing an arm stretch and waist bend exercise with the aid of a building wall section W or other suitable structure to resist sliding movement of the device on the floor. The truncated corner 17 is placed flush to a wall W. The individual P then kneels on the floor F at the side of the device having the panel 15*b*. The gripping portion 20 of the exercise bar is held in the hands and the person leans forward over the physical exercising device, thus extending his arms and bending at the waist. The lower back muscles are stretched and abdominal muscles tightened as the body is moved in an oscillatory manner. Additionally, the arm and shoulder muscles are developed or exercised.

FIG. 10 illustrates an individual P performing a leg raise weight-lift exercise. This exercise is accomplished by having the individual place one or both legs beneath the exercise bar such that his hips rest against the body support surface portion section 15*b*. While in a reclined position as shown in FIG. 10, the individual lifts the lower portion of one or both of his legs to an elevated position as shown in broken lines against the resisting force of the springs 13 to tone and strengthen the stomach, hip and leg muscles. While it is understood that sufficient exercise may be obtained using this device in the illustrated manner, greater or less effect may be obtained by changing the springs 13 to those springs having greater or less force or strength. It must also be understood that dead weight (not shown) could be added to the gripping portion of the bar, thus increasing the resistance over that already existing and produced by the springs.

It will be readily apparent from the foregoing detailed description of illustrative embodiments of this invention that a particularly novel and extremely effective physical exercising device is provided. This physical exercising device is relatively simple to fabricate and requires a minimal effort to position on a surface for use in the performance of exercises. The structure is economical to fabricate and results in a physical exercising device capable of performing a variety of exercises. The specific wedge-shaped configuration of the base unit is both practical and functional, but also helpful in reducing the injuries from the straining of muscles which may occur during certain types of exercises. The inclined surface panels of the base unit and the dimensional configuration enable the person using the device to comfortably support his legs in an elevated inverted V-configuration while the person's body weight acting through his legs will tend to hold the device in position and resist exercising forces that may be developed.

Having thus described the invention, what is claimed is:

1. A physical exercising device comprising a base unit of elongated, wedge-shaped configuration having a generally triangular cross-section, said base unit including two upwardly inclined body supporting surfaces converging at an apex a predetermined distance above a bottom adapted to rest on a supporting surface, and an exercise bar pivotably mounted on said base unit for swinging movement about a horizontal pivot axis extending longitudinally of said base unit, said exercise bar including a gripping portion extending longitudinally of said base unit and supported at a predetermined distance with respect to the horizontal pivot axis of said bar and to a body supporting surface of said base unit to permit swinging of said bar from one body supporting surface to the other of said base unit over the apex thereof in an arc about said pivot axis such that said gripping portion will contactingly engage with the uppermost surface portions of a person's leg adjacent the ankles when a person's legs are extended over the base unit with the knees disposed at approximately the apex thereof.

2. A physical exercising device according to claim 1 which includes resilient biasing means interconnected with said exercise bar to resist swinging movement thereof through at least some portions of its arc of movement.

3. A physical exercising device according to claim 2 wherein said biasing means comprises a pair of helical springs having opposite ends thereof mechanically interconnected with said exercise bar and said base unit.

4. A physical exercising device according to claim 2 wherein said biasing means is interconnected with said exercise bar to urge said bar toward either of said two body supporting surfaces.

5. A physical exercising device according to claim 1 wherein said exercise bar has a gripping portion that is of one unbroken extent.

6. A physical exercising device comprising a base unit of elongated, wedge-shaped configuration having a generally triangular cross-section, said base unit including two upwardly inclined body supporting surfaces converging at an apex a predetermined distance above a bottom adapted to rest on a supporting surface, and a structural support element disposed at each end thereof in structurally fixed relationship, and an exercise bar pivotably mounted on said base unit for swinging movement about a horizontal pivot axis extending longitudinally of said base unit, said exercise bar including a gripping portion extending longitudinally of said base unit and supported at a predetermined distance from the pivot axis of said bar to permit swinging thereof from one body supporting surface to the other of said base unit over the apex thereof in an arc about said pivot axis and a pair of connecting portions connected to said gripping portion in longitudinally spaced relationship to each other, each of said connecting portions extending relatively transversely to said gripping portion and having a terminal end portion adapted for pivotal mounting on a respective structural support element of said base unit and carrying said gripping portion at the predetermined distance from said pivot axis.

7. A physical exercising device according to claim 1 wherein said gripping portion of said exercise bar is formed in two sections defining an intermediate space therebetween disposed centrally of said base unit.

8. A physical exercising device according to claim 7 wherein the two sections of said gripping portion are rigidly interconnected for concurrent movement.

9. A physical exercising device comprising a base unit of elongated, wedge-shaped configuration having a generally triangular cross-section, said base unit including two upwardly inclined body supporting surfaces converging at an apex a predetermined distance above a bottom adapted to rest on a supporting surface, and an exercise bar pivotably mounted on said base unit for swinging movement about a horizontal pivot axis extending longitudinally of said base unit, said exercise bar including a gripping portion extending longitudinally of said base unit and supported at a predetermined distance from the pivot axis of said bar to permit swinging thereof from one body supporting surface to the other of said base unit over the apex thereof in an arc about said pivot axis, said gripping portion of said exercise bar being formed in two sections defining an intermediate space therebetween disposed centrally of said base unit, said two sections of said gripping portion being independently pivotable.

10. A physical exercising device according to claim 1 wherein said body support surfaces are covered with cushioning material.

11. A physical exercising device comprising a base unit of elongated, wedge-shaped configuration having a generally triangular cross-section, said base unit including two upwardly inclined body supporting surfaces converging at an apex a predetermined distance above a bottom adapted to rest on a supporting surface, and an exercise bar pivotably mounted on said base unit for swinging movement about a horizontal pivot axis extending longitudinally of said base unit, said exercise bar including a gripping portion extending longitudinally of said base unit and supported at a predetermined distance from the pivot axis of said bar to permit swinging thereof from one body supporting surface to the other of said base unit over the apex thereof and connecting portions extending transversely to said gripping portion at each end thereof with each having a terminal end portion adapted for pivotal mounting on said base unit, each of said terminal end portions being cylindrically shaped and said base unit is provided with sockets in which respective ones of said terminal end portions are journalled.

12. A physical exercising device according to claim 11 wherein said base unit includes upstanding end panels having said sockets formed therein.

13. A physical exercising device according to claim 12 wherein said base unit includes respective, longitudinally extending structurally rigid panels forming said body supporting surfaces, and said end panels are rigidly interconnected therewith forming a structural rigid unit.

* * * * *